US009441920B2

(12) United States Patent
Fernandez

(10) Patent No.: US 9,441,920 B2
(45) Date of Patent: Sep. 13, 2016

(54) ARMOR MATERIALS AND STRUCTURES AND METHODS

(71) Applicant: David Fryderyk Fernandez, Camarillo, CA (US)

(72) Inventor: David Fryderyk Fernandez, Camarillo, CA (US)

(73) Assignee: David Fryderyk Fernandez, Camarillo, CA (US)

( * ) Notice: Subject to any disclaimer, the term of this patent is extended or adjusted under 35 U.S.C. 154(b) by 27 days.

(21) Appl. No.: 14/470,512

(22) Filed: Aug. 27, 2014

(65) Prior Publication Data

US 2016/0061569 A1 Mar. 3, 2016

(51) Int. Cl.

| | |
|---|---|
| ***F41H 5/02*** | (2006.01) |
| ***F41H 5/04*** | (2006.01) |
| ***F41H 5/013*** | (2006.01) |
| ***F41H 5/08*** | (2006.01) |
| ***F41H 5/24*** | (2006.01) |
| ***F41H 11/08*** | (2006.01) |

(52) U.S. Cl.

CPC ..... *F41H 5/04* (2013.01); *F41H 5/013* (2013.01); *F41H 5/08* (2013.01); *F41H 5/24* (2013.01); *F41H 11/08* (2013.01)

(58) Field of Classification Search

CPC ..... F41H 5/04; F41H 5/013; F41H 5/08; F41H 5/24; F41H 11/08

USPC ..... 89/36.01, 36.02; 428/911; 109/49.5

See application file for complete search history.

(56) References Cited

U.S. PATENT DOCUMENTS

| | | | | |
|---|---|---|---|---|
| 2,640,987 | A * | 6/1953 | Ehlers | F41H 1/02 2/2.5 |
| 3,228,361 | A * | 1/1966 | Ritter | F41H 5/04 109/84 |
| 3,398,406 | A * | 8/1968 | Waterbury | B63C 9/087 2/2.5 |
| 4,241,457 | A * | 12/1980 | Klein | F41H 5/0478 2/2.5 |
| 5,224,363 | A * | 7/1993 | Sutton | A41D 19/0058 2/16 |
| 7,601,416 | B2 | 10/2009 | Palley | |
| 8,534,178 | B2 | 9/2013 | Howland et al. | |
| 2008/0307553 | A1 * | 12/2008 | Jbeili | F41H 5/0428 2/2.5 |

* cited by examiner

*Primary Examiner* — Samir Abdosh
(74) *Attorney, Agent, or Firm* — Foley & Lardner LLP

(57) ABSTRACT

Armor material, armor shields and other armor structures are composed of a continuous piece of material that is pressed and molded or otherwise processed to have two or more panels connected together at hinge portions, to form a foldable (or partially foldable) configuration. In a folded state the armor structure can provide a greater penetration stopping capability or NIJ rating, or both, as compared to an unfolded state. Such multi-panel armor structures are configured as foldable shields, walls, and enclosures.

24 Claims, 15 Drawing Sheets

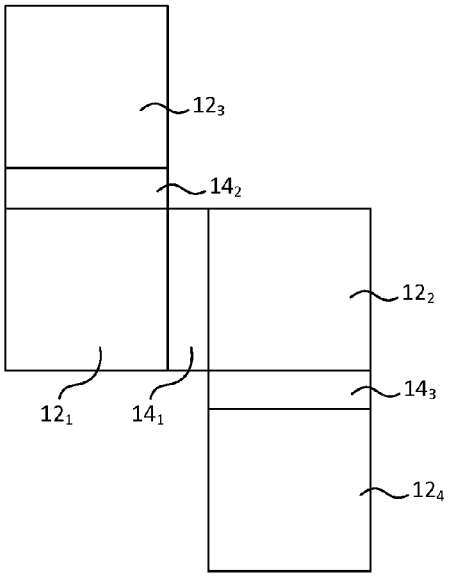
FIG. 7f
FIG. 7g
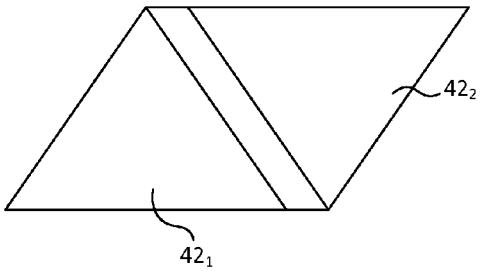
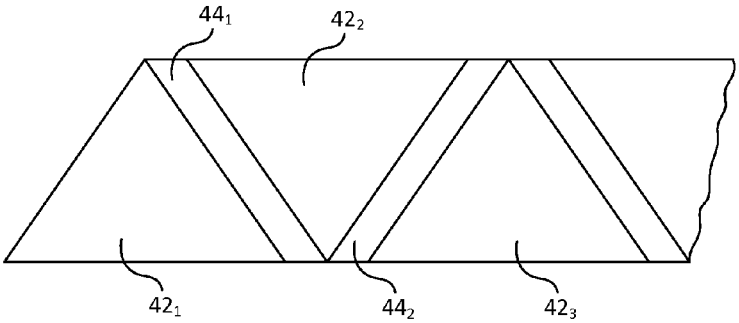
FIG. 7h

ARMOR MATERIALS AND STRUCTURES AND METHODS

FIELD OF THE INVENTION

Embodiments of the present invention relate to armor material and armor shields and other armor structures, and processes of making and using such materials and structures. Particular embodiments relate to armor structures having a continuous piece of high-strength material forming two or more panels with one or more hinge portions between adjacent panels, in a foldable (or partially foldable) configuration, and processes of making and using the same.

BACKGROUND

Tactical shields and armor are commonly used by citizens, high profile individuals, security, police and military forces for protection in armed, hostile situations. Shields and armor can be made for protection against low velocity projectiles, such as rocks, fists, sticks, bottles or the like. Other types of shields and armor can be made for protection against certain types of bullets, fragments, shrapnel or other higher velocity, small projectiles. Bullet-resistant shields are typically made with high-strength synthetic composite materials, such as, those based on ultra-high-molecular-weight polyethylene (UHMWPE) fiber, Aramid fiber, glass-fiber reinforced plastic (fiberglass), carbon fiber or other composite materials, including materials known as Kevlar™, Dyneema™, Gold Flex™, Twaron™, Spectra™, Zylon™, or the like.

Shields and armor are rated in levels or standards, such as those set by the U.S. National Institute of Justice (NIJ) or the U.K. Home Office Scientific Development Branch (HOSDB), based on their stopping capabilities. For example, lighter weight shields and armor made for protection against certain types of shotgun or smaller caliber bullets, such as fired from many types of smaller hand guns and submachine guns, can be rated as NIJ level IIA or II. Shields and armor made for protection against larger caliber bullets, such as a .44 caliber magnum bullets can be rated as NIJ level IIIA. Heavier level shields and armor (such us those rated NIJ level III and IV) are made for protection against larger caliber or higher velocity bullets, such as fired from many types of rifles.

An armor shield or other armor structure may be rated according to NIJ levels, a manufacturer's specification, or other rating scale, based on its ability to resist penetration by a bullet or other projectile. Typically, if a user desires a lighter weight, lower level shield for certain operations, and also desires a heavier, higher level shield for other operations, the user must carry or have available multiple shields.

Armor material can be formed in panels or plates. Multiple plates of armor material can be sewn or otherwise attached together, or overlapped to form armor shields or other armor structures. Flexible armor fabrics (such as Kevlar™ soft armor) can be made into vests and other wearable items of various level ratings. However, due to the flexibility of such fabrics, impacts from large or high velocity objects can result in higher blunt force trauma injuries to the user. Rigid armor materials can provide additional protection against blunt force trauma. However, large, rigid armor structures can be difficult to store and carry, especially if multiple structures (e.g., multiple shields of different level ratings) are to be stored or carried.

SUMMARY

Embodiments of the present invention relate to armor structures having a continuous piece of high-strength material forming two or more panels with one or more hinge portions between adjacent panels, to provide a foldable (or partially foldable) configuration. In particular embodiments, one panel may be folded over a second panel to reduce the width (or other dimension) of the armor structure, to increase the penetration-stopping ability, or to increase the level rating of the armor structure (or any combination thereof). Accordingly, various embodiments provide versatile armor structures that can provide a variety of advantages relating to storage ability, portability, multiple modes of use, or combinations thereof.

A multi-panel armor structure according to certain embodiments includes a plurality of panels formed with a continuous piece of material. Each panel is composed of a portion, but not all of the continuous piece of material, and a binding material associated with the portion of the continuous piece of material and forming, with the portion of the continuous piece material, a rigid panel having or exceeding at least one of a predefined penetration stopping capability and a predefined NIJ rating. Each panel is spaced from at least one adjacent panel by a hinge portion formed of the continuous piece of material between the panel and each adjacent panel, the hinge portion allowing pivotal motion of at least one of the panels relative to at least one other panel.

According to further embodiments, the binding material is molded with the portion of the continuous piece material to form a generally rigid panel, the hinge portion being sufficiently free of the binding material to be flexible and allow the pivotal motion.

According to further embodiments, the binding material is molded with the portion of the continuous piece material to form a generally rigid panel, the hinge portion including the binding material but is not molded so as to remain flexible to allow the pivotal motion.

According to further embodiments, the plurality of panels include at least three panels connected together by at least two hinge portions of the continuous piece of material, wherein each panel is connected to an adjacent panel by a respective one of the hinge portions of the continuous piece of material.

According to further embodiments, the hinge portions are configured to allow pivotal motion of the at least one panel from an unfolded state to a folded state, wherein in the folded state the at least one panel is folded over the at least one other panel to form a stack of panels.

According to further embodiments, the stack of panels has a width dimension that is less than a corresponding width dimension of two panels in the unfolded state.

According to further embodiments, the continuous piece of material comprises a plurality of stacked, flexible sheet layers of an ultra-high-molecular-weight polyethelene material.

According to further embodiments, the continuous piece of material comprises at least one of ultra-high-molecular-weight polyethelene, aramid, glass-fiber reinforced plastic (fiberglass), carbon fiber or other composite materials, including materials known as Kevlar™, Dyneema™, Gold Flex™, Twaron™, Spectra™ and Zylon™.

According to further embodiments, the continuous piece of material comprises a plurality of stacked, flexible sheet layers and wherein each sheet layer comprises a plurality of sheet layer segments arranged in a partially overlapping manner to form a sheet layer.

According to further embodiments, each panel of the plurality of panels is connected to an adjacent panel of the plurality of panels by a respective one of the hinge portions of the continuous piece of material to form an armor wall structure when the panels are in an unfolded state.

According to further embodiments, the plurality of panels include at least three panels connected together by at least two hinge portions of the continuous piece of material, wherein each panel is connected to an adjacent panel by a respective one of the hinge portions of the continuous piece of material, and wherein the at least three panels and at least two hinge portions are configured to fold in an accordion manner to a folded state.

According to further embodiments, at least one of the panels is configured to connect to a fixed wall, to allow the at least three panels and at least two hinge portions to unfold in an accordion manner to an unfolded state in which the at least three panels extend from or along the fixed wall.

According to further embodiments, the multi-panel armor structure further includes a sleeve, coating or layer of protective material at least partially covering at least one of the panels.

According to further embodiments, the multi-panel armor structure further includes a sleeve of fabric at least partially covering at least one of the panels, the sleeve having at least one of a strap, a pocket, a loop of material, a handle, a connector and a receptacle for holding equipment.

According to further embodiments, the multi-panel armor structure further includes at least one handle coupled to at least one of the plurality of panels.

According to further embodiments, the at least one handle is molded on the at least one panel.

According to further embodiments, the multi-panel armor structure further includes a plurality of handles coupled to two or more of the plurality of panels, the plurality of handles arranged for two or more people to grip the handles and hold the multi-panel armor structure when the plurality of panels are arranged in an unfolded state.

According to further embodiments, the plurality of handles are arranged for at least one person to grip at least two of the handles and hold the multi-panel armor structure when the plurality of panels are arranged in a folded state.

According to further embodiments, each panel of the plurality of panels is connected to an adjacent panel of the plurality of panels by a respective one of the hinge portions of the continuous piece of material to form an enclosure having an interior volume when in an unfolded state.

According to further embodiments, the plurality of panels are connected together by hinge portions configured for one or more panels to fold over an adjacent panel to form a single-panel-wide structure in a folded state.

A method of making a multi-panel armor structure according to certain embodiments includes providing a continuous piece of flexible, high-strength material; processing a first portion of the continuous piece material with a binding material to form a first rigid panel having or exceeding at least one of a predefined penetration stopping capability and a predefined NIJ rating; and processing a second portion of the continuous piece of flexible, high-strength material with the binding material to form a second panel having or exceeding at least one of a predefined penetration stopping capability and a predefined NIJ rating, the second panel being spaced from the first panel by a further portion of the continuous piece of flexible, high-strength material that forms a hinge portion between the first and second panels, the hinge portion allowing pivotal motion of at least one of the first and second panels relative to at least one other of the first and second panels.

According to further embodiments of that method, the continuous piece of material comprises a plurality of stacked, flexible sheet layers of an ultra-high-molecular-weight polyethelene material.

According to further embodiments of that method, the continuous piece of material comprises at least one of ultra-high-molecular-weight polyethelene, aramid, glass-fiber reinforced plastic (fiberglass), carbon fiber or other composite materials, including materials known as Kevlar™, Dyneema™, Gold Flex™, Twaron™, Spectra™ and Zylon™.

According to further embodiments of that method, the continuous piece of material comprises a plurality of stacked, flexible sheet layers, where the method further includes forming at least one of the flexible sheet layers with a plurality of sheet layer segments arranged in a partially overlapping manner.

BRIEF DESCRIPTION OF THE DRAWINGS

The accompanying drawings, which are incorporated herein and constitute part of this specification, illustrate exemplary embodiments of the invention, and together with the general description given above and the detailed description given below, serve to explain the features of the various embodiments.

FIGS. 7*a-k* show various embodiments of multi-panel armor structures in unfolded states, according to embodiments of the present invention.

DETAILED DESCRIPTION

Various embodiments will be described in detail with reference to the accompanying drawings. Wherever possible, the same reference numbers may be used throughout the drawings to refer to the same or like parts. Different reference numbers may be used to refer to different, same, or similar parts. References made to particular examples and implementations are for illustrative purposes, and are not intended to limit the scope of the invention or the claim.

Figure 1A:
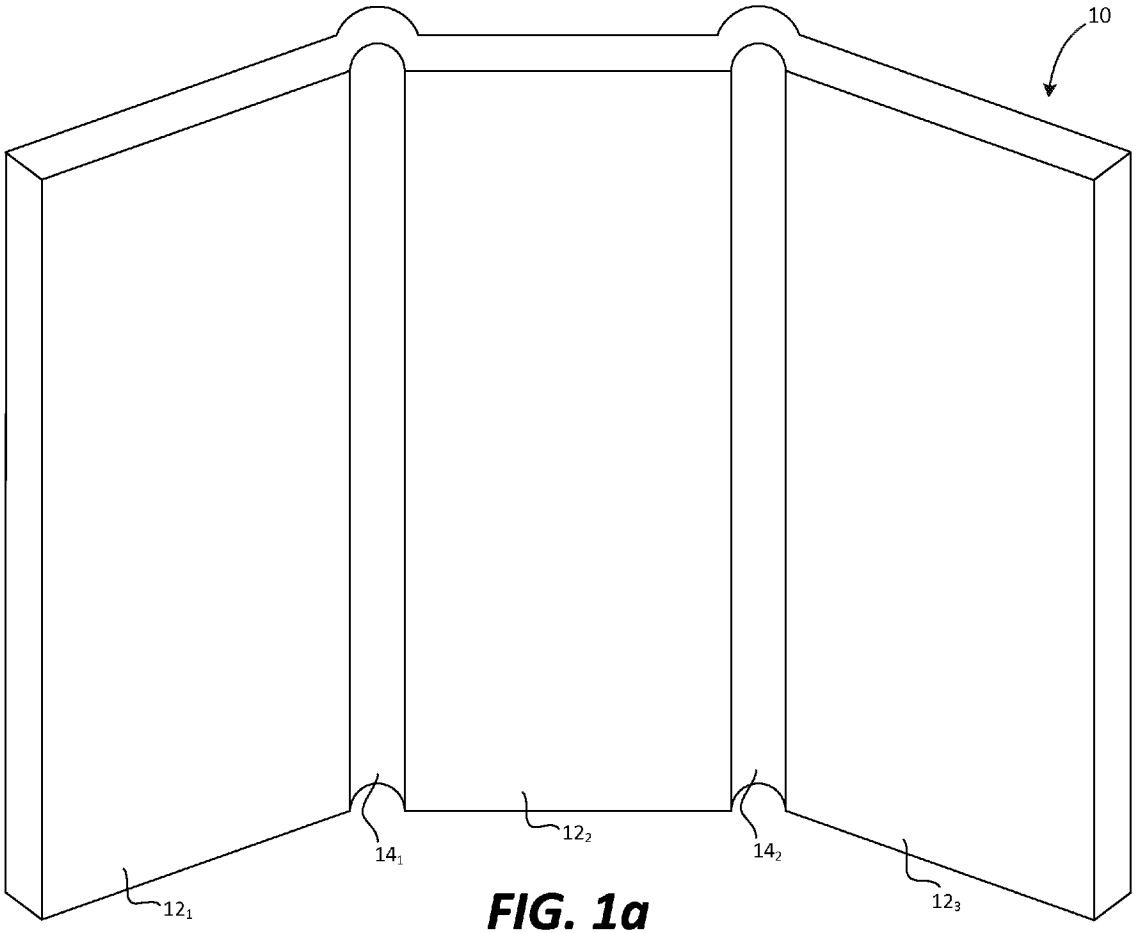
FIG. 1*a* is a perspective view of a multi-panel armor structure in a partially unfolded state according to an embodiment of the present invention.

An example embodiment of a multi-panel armor structure 10 made of an armor material is shown in the embodiment of FIG. 1*a*. The multi-panel armor structure 10 includes a continuous piece of high-strength laminate material (or other layered material) forming a plurality of armor panels and one or more hinge portions between adjacent panels. In further embodiments, the continuous piece of high-strength material is a woven or unwoven web of material. Each panel is a rigid or semi-rigid section of the continuous piece of material, while each hinge portion is a flexible section of the continuous piece of material. In the embodiment of FIG. 1*a*, the multi-panel armor structure 10 includes three rectangular panels labeled $\mathbf{12}_1$, $\mathbf{12}_2$ and $\mathbf{12}_3$ and two hinge portions labeled $\mathbf{14}_1$ and $\mathbf{14}_2$. In other embodiments, the multi-panel armor structure includes two panels and one hinge portion, or more than three panels and more than two hinge portions. In the embodiment of FIG. 1*a*, the hinge portion $\mathbf{14}_1$ is configured to allow the panel $\mathbf{12}_1$ to pivot up to 180° in one direction (outward from the page in FIG. 1*a*) and fold over a first surface (the surface facing out from the page in FIG. 1) of the adjacent panel $\mathbf{12}_2$. Similarly, the hinge portion $\mathbf{14}_2$ is configured to allow the panel $\mathbf{12}_3$ to pivot up to 180° in the same direction (outward from the page in FIG. 1*a*) and fold over the same first surface of the adjacent panel $\mathbf{12}_2$ (and to fold over the panel $\mathbf{12}_1$ after the panel $\mathbf{12}_1$ is first folded over the first surface of the adjacent panel $\mathbf{12}_2$), as shown in FIG. 2*a*.

Figure 1B:
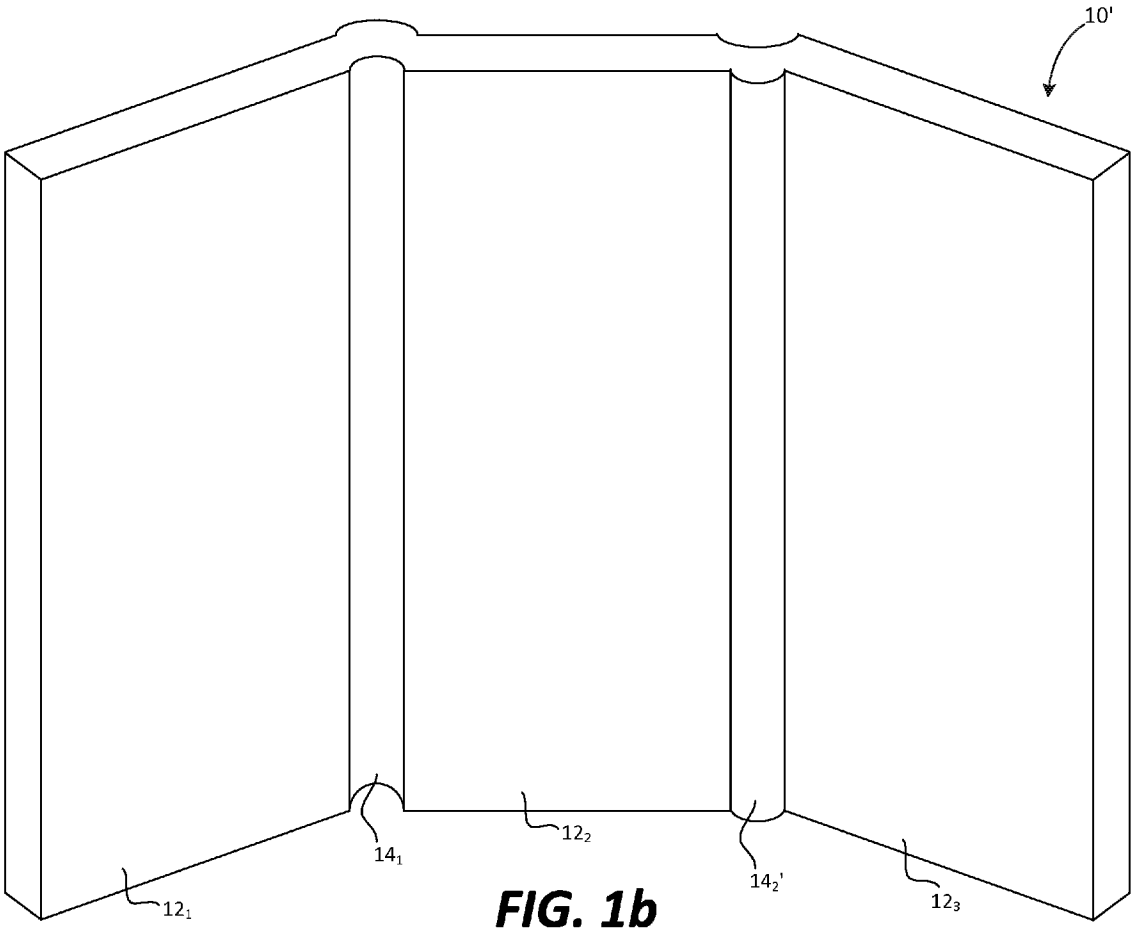
FIG. 1*b* is a perspective view of a multi-panel armor structure in a partially unfolded state according to an embodiment of the present invention.

A similar three-panel armor structure 10' is shown in FIG. 1*b*, where like features are labeled with like reference numbers with respect to FIG. 1*a*. In the embodiment of FIG. 1*b*, the two hinge portions $\mathbf{14}_1$ and $\mathbf{14}_2$' are configured to fold in opposite directions relative to each other. More specifically, in the embodiment of FIG. 1*b*, the hinge portion $\mathbf{14}_1$ is configured to allow the panel $\mathbf{12}_1$ to pivot up to 180° in one direction (outward from the page in FIG. 1*a*) and fold over a first surface (the surface facing out from the page in FIG. 1) of the adjacent panel $\mathbf{12}_2$, similar to the embodiment of FIGS. 1*a* and 2*a*. However, in FIG. 1*b*, the hinge portion $\mathbf{14}_2$' is configured to allow the panel $\mathbf{12}_3$ to pivot up to 180° in the opposite direction (into the page in FIG. 1*b*) and fold over a second or opposite-facing surface (the surface facing into the page in FIG. 1*b*) of the adjacent panel $\mathbf{12}_2$, as shown in FIG. 2*b*. In further embodiments, one or more (or all) hinge portions of the armor structure are configured to pivot in both directions, for example, up to 360° overall.

Figure 2A:
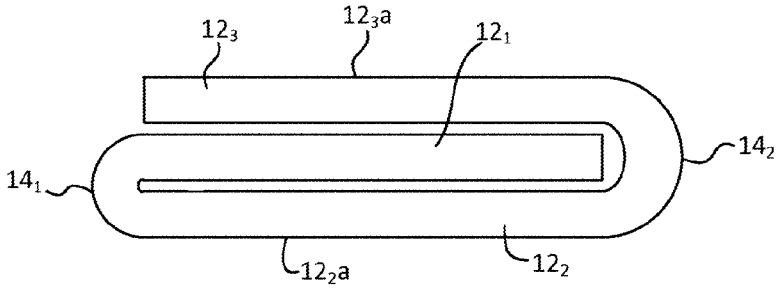
FIG. 2*a* is an end view of a multi-panel armor structure of FIG. 1*a*, in a folded state.
Figure 2B:
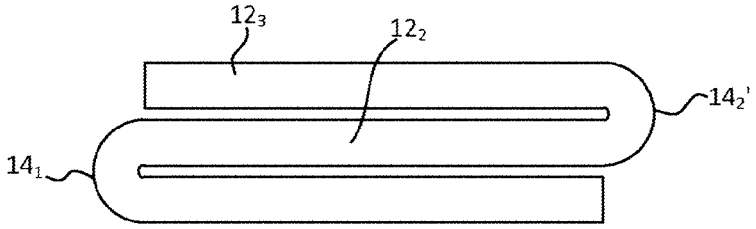
FIG. 2*b* is an end view of a multi-panel armor structure of FIG. 1*b*, in a folded state.

Thus, the embodiments of FIGS. 1*a* and 1*b* provide a foldable, multi-panel armor structure that includes a plurality of panels and a plurality of hinge portions, where one or more panels may fold over an adjacent panel to form a folded (folded state), approximating a single-panel-wide structure (with some additional width of the folded hinge portions), as shown in FIGS. 2*a* and 2*b*. In other embodiments, only one of the panels $\mathbf{12}_1$ or $\mathbf{12}_3$ may be folded over the adjacent panel $\mathbf{12}_2$ to form a two or more panel wide structure in a folded state. In yet further multi-panel armor structure embodiments having more than three panels, one or more of the panels may fold over one or more respective adjacent panels to form (in a folded state) a folded armor structure having a width that is one or more panel-widths less than the unfolded width of the multi-panel armor structure.

According to embodiments of the present invention, a multi-panel structure as described above is formed from a single, continuous piece of flexible, high-strength material 20 (where high-strength refers to having sufficient strength to provide an armor structure), when configured as described herein. The continuous piece of flexible, high-strength material 20, when formed into panels as shown in FIGS. 1*a* and 1*b* (and other embodiments described herein) has an NIJ level rating (or other predefined rating determined by the manufacturer or other entity) for providing predefined or sufficient penetration stopping capabilities. In particular embodiments, the continuous piece of material 20 includes one or more layers of a flexible, high-strength composite material(s). In certain embodiments, the piece of material 20 is a multi-layer laminate (or other multi-layer configuration) of flexible, high-strength composite material(s). In particular embodiments, each of the layers of flexible, high-strength material is selected for penetration stopping capabilities and may be composed of any suitable material, such as, but not limited to: high-strength synthetic materials including but not limited to high-strength synthetic composite materials, such as, ultra-high-molecular-weight polyethylene (UHMWPE), UKMWPE fiber, Aramid, Aramid fiber, glass-fiber reinforced plastic (fiberglass), carbon fiber or other composite materials, including materials known as Kevlar™, Dyneema™, Gold Flex™, Twaron™, Spectra™, Zylon™, or the like.

In embodiments in which the continuous piece of material 20 is composed of multiple sheet layers, where each sheet layer is composed of the same type of material as each other sheet layer. In other embodiments in which the continuous piece of material 20 is composed of multiple layers, one or more (or each) sheet layer is composed of a different type of material (such as, but not limited to, a different one of the above-referenced materials) relative to one or more (or each) other sheet layer. In further embodiments in which the continuous piece of material 20 is composed of multiple sheet layers, two or more of the sheet layers is formed by folding a portion of a sheet material over itself or over another sheet layer.

Figure 4:
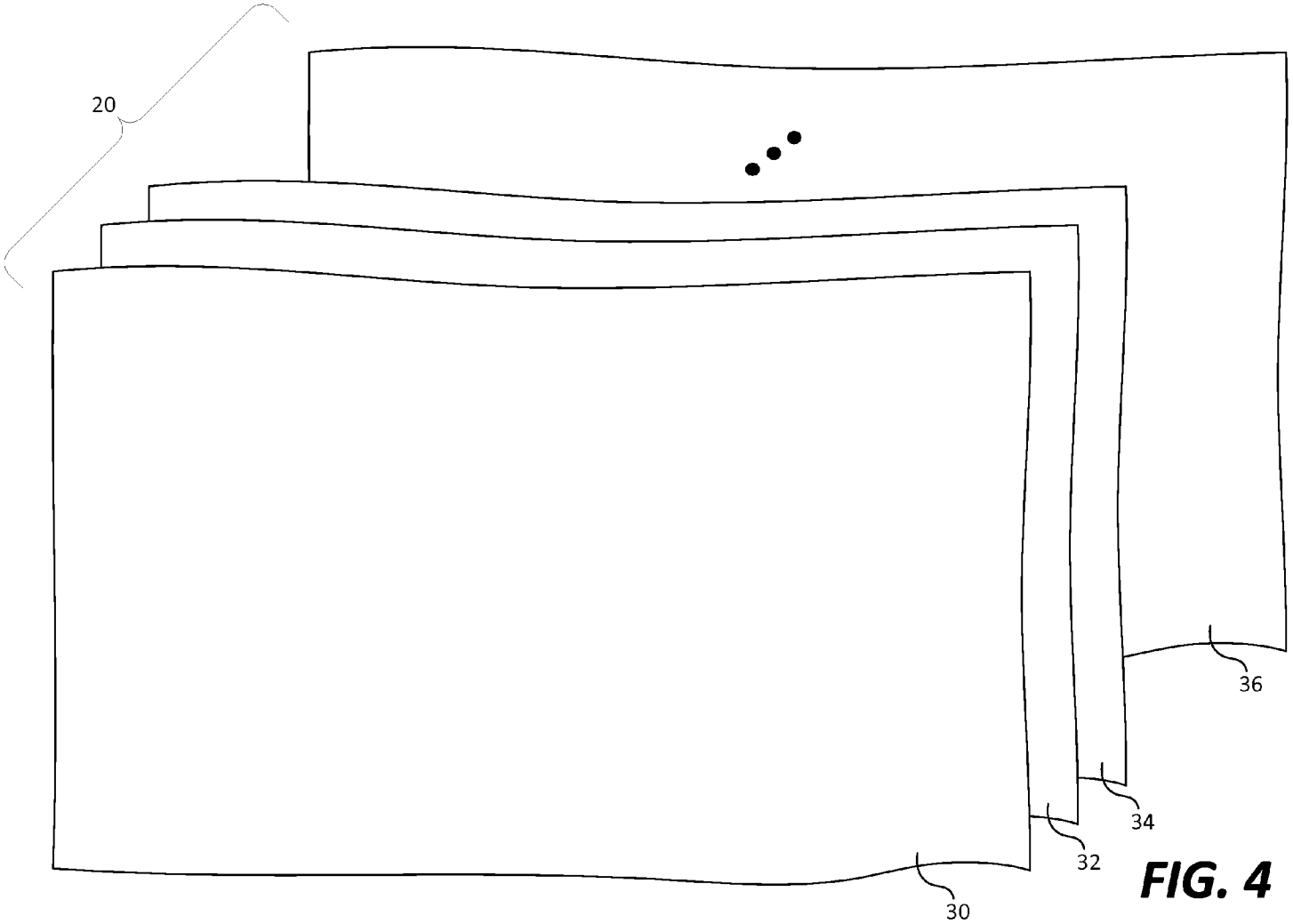
FIG. 4 is an exploded view of the web material of FIG. 3.

In the embodiment of FIG. 4, the continuous piece of material 20 is shown with a plurality of sheet layers (e.g., the sheet layers labeled 30, 32, 34 and 36 in FIG. 4) of flexible sheet material. The sheet layers 30, 32, 34 and 36 are stacked to form a single sheet of material 20. While the embodiment in FIG. 4 shows a continuous piece of material 20 with four sheet layers, other embodiments may be formed with a single sheet layer or any suitable number of sheet layers, stacked one on another as shown in FIG. 4. In particular embodiments, the number of sheet layers in the continuous piece of material 20 is between about 15 and about 75.

The number of sheet layers in the continuous piece of material 20 may be selected, to provide the desired strength and penetration stopping capabilities (or NIJ level or other rating). Typically, more layers in the continuous piece of sheet of material 20, results in a stronger armor structure (and higher penetration stopping capability, or NIJ or other rating). However, the number of sheet layers and the type of sheet material used can affect the overall weight and cost of the armor structure. Accordingly, embodiments of the present invention are configured with a select number of sheet layers and one or more select types of sheet layer materials in the continuous piece material 20, selected to provide a desired strength (penetration stopping capability, NIJ rating or other rating), overall weight and cost.

As described above, in particular embodiments, each sheet layer (e.g., layer 30, 32, 34 and 36) of the continuous piece of material 20 is composed of the same type of material. In other embodiments, one or more of the layers of the continuous piece of material 20 are composed of a different material than one or more other layers of the continuous piece of material.

Figure 5:
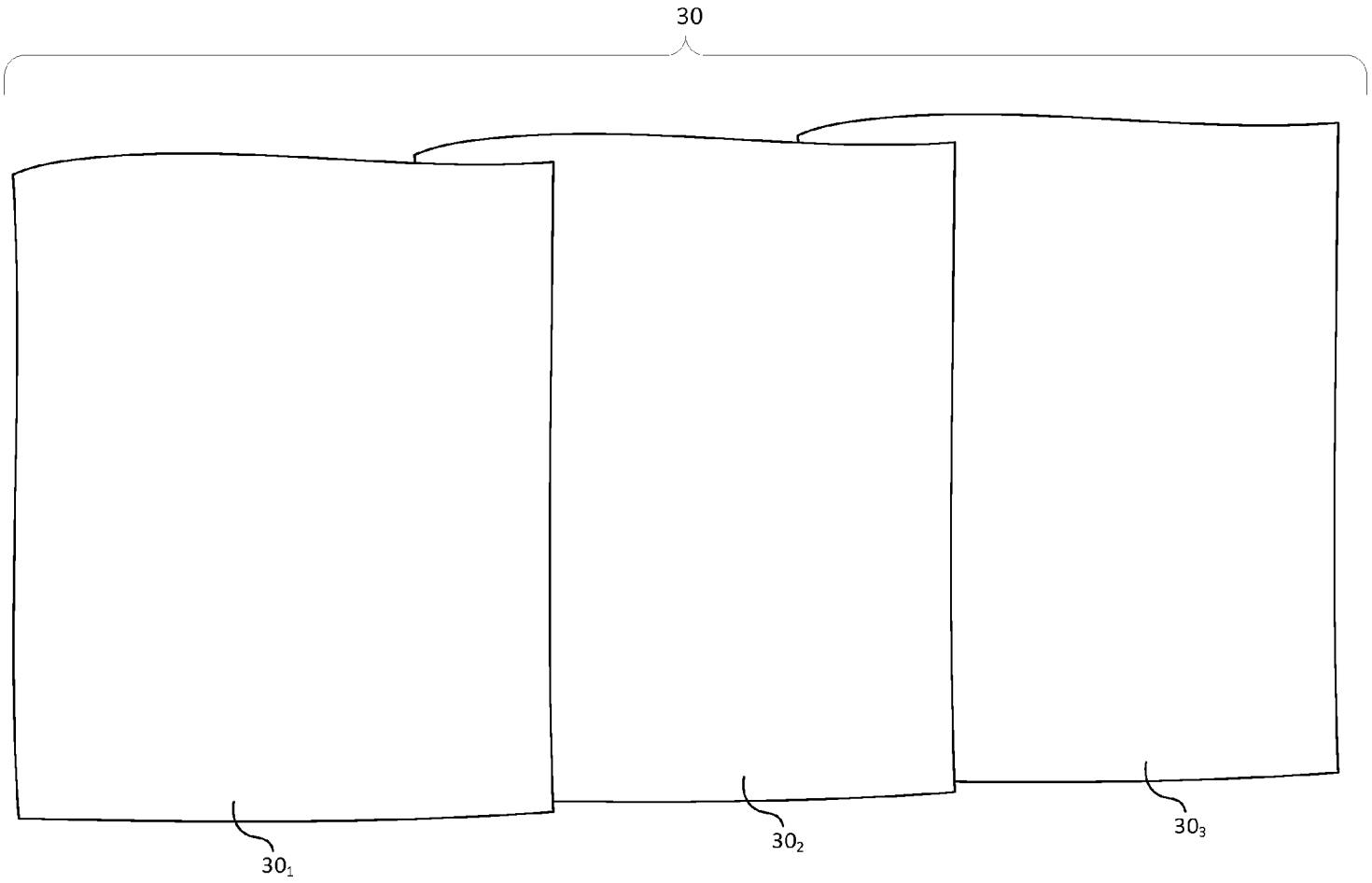
FIG. 5 is a graphical representation of a sheet layer and component sheets thereof, for the web material of FIG. 3.

In particular embodiments, each sheet layer is composed of a plurality of sheet layer segments (segments of the sheet layer material) arranged in an overlapping manner, as shown in FIG. 5. In the embodiment of FIG. 5, the sheet layer 30 is composed of three sheet layer segments $\mathbf{30}_1$, $\mathbf{30}_2$ and $\mathbf{30}_3$. Sheet layer segment $\mathbf{30}_1$ partially (but not fully) overlaps sheet layer segment $\mathbf{30}_2$. Similarly, sheet layer segment $\mathbf{30}_2$ partially (but not fully) overlaps sheet layer segment $\mathbf{30}_3$. The sheet layer segments $\mathbf{30}_1$, $\mathbf{30}_2$ and $\mathbf{30}_3$ are bonded together by any suitable bonding mechanism such as, but not limited to an adhesive, a binding material as described herein, or the like, to form the sheet layer 30. This configuration allows one or more (or each) sheet layer of the continuous piece of material 20 (FIGS. 3 and 4) to be formed from smaller sheet layer segments $\mathbf{30}_1$, $\mathbf{30}_2$ and $\mathbf{30}_3$. Accordingly, the width (and/or one or more other dimensions) of the sheet layer of continuous piece of material 20 (and, thus, the width or other dimension(s) of the continuous piece of material 20) can be larger than the corresponding width (or other dimension(s)) of the sheet layer segments $\mathbf{30}_1$, $\mathbf{30}_2$ and $\mathbf{30}_3$ that form the sheet layer.

In particular embodiments, each sheet layer of the continuous piece of material 20 is formed of multiple overlapping sheet layer segments in manner similar to that shown in FIG. 5. In other embodiments, one or more, but not all of the sheet layers of the continuous piece of material 20 are formed of multiple overlapping sheet layer segments in a manner similar to that shown in FIG. 5, while other sheet layers are formed of a single segment. In yet other embodiments one or more (or all) of sheet layers of the continuous piece of material 20 are formed of a single segment (instead of multiple, overlapping segments). While the embodiment in FIG. 4 includes three sheet layer segments $\mathbf{30}_1$, $\mathbf{30}_2$ and $\mathbf{30}_3$ for forming a layer 30 of the continuous piece of material 20, other embodiments employ two sheet layer segments or more than three sheet layer segments arranged in an overlapping configuration to form one or more (or each) of the layers of the continuous piece of material 20. In particular embodiments, one or more (or each) layer of the continuous piece of material 20 is formed of a different number of sheet layer segments that one or more (or each) other layer in the continuous piece of material.

The continuous piece of material 20 is formed into two or more panels (three panels $\mathbf{12}_1$, $\mathbf{12}_2$ and $\mathbf{12}_3$ in the embodiment of FIGS. 1*a* and 1*b*), with a hinge portion (e.g., hinge portions $\mathbf{14}_1$ and $\mathbf{14}_2$) located between each adjacent panel. In particular embodiments, each panel $\mathbf{12}_1$, $\mathbf{12}_2$ and $\mathbf{12}_3$ is formed by compressing a predefined section of the continuous piece of material 20 in a mold or other support structure with a flowable binding material (such as, but not limited to, a thermo plastic resin, TPU, rubber elastomer, epoxy other thermoset or curable resin, or the like). In particular embodiments, the flowable binding material is included in the continuous piece of material 20 (for example, included in one or more (or all) of the sheet layers of the continuous piece of material 20). In such embodiments, the flowable binding material may be infused in or coated on fibers of the sheet layer(s) and solidified (or partially solidified) before assembly, but re-flowable with heat or other processing to form the panels, as described below. In other embodiments, some or all of the flowable binding material may be added to the continuous piece of material 20, during a process of forming the panels.

For example, each predefined panel section of the continuous piece of material 20 may be pressed in a mold, with suitable, predefined pressure and temperature (heat), in conjunction with a curable resin or other binding material in the mold, to form a respective panel on the continuous piece of material 20. By pressing and molding multiple, separated, predefined panel sections of the single continuous piece of material 20, the continuous piece of material forms multiple panels (e.g., panels $\mathbf{12}_1$, $\mathbf{12}_2$ and $\mathbf{12}_3$) separated by unpressed/unmolded sections of the continuous piece of material 20 that form hinge portions (e.g., hinge portions $\mathbf{14}_1$ and $\mathbf{14}_2$). In particular embodiments, each predefined panel section of the continuous piece of material 20 (which forms one of the panels $\mathbf{12}_1$, $\mathbf{12}_2$ and $\mathbf{12}_3$) is separated from each adjacent predefined panel section of the continuous piece of material 20 (which forms another one of the panels $\mathbf{12}_1$, $\mathbf{12}_2$, and $\mathbf{12}_3$) by a predefined distance to form a hinge portion (e.g., one of the hinge portions $\mathbf{14}_1$ and $\mathbf{14}_2$). In embodiments in which the binding material is added during the molding or compressing process, the hinge portions (e.g., hinge portions $\mathbf{14}_1$ and $\mathbf{14}_2$) may remain free of the binding material. In embodiments in which the binding material is included in the continuous piece of material 20, the hinge portions (e.g., hinge portions $\mathbf{14}_1$ and $\mathbf{14}_2$) include binding material, but are not pressed and heated, such that the hinge portions remain sufficiently flexible to bend.

In other embodiments, multiple panels (e.g., panels $\mathbf{12}_1$, $\mathbf{12}_2$ and $\mathbf{12}_3$) are formed in the continuous piece of material 20 with an autoclave or other pressure chamber process instead of, or in addition to a molding process as described above. In such embodiments, the panel sections are formed in a pressurized, heated chamber sufficient to consolidate the panel sections of the continuous piece of material 20 into rigid or semi-rigid panels. In yet other embodiments, resin transfer molding (RTM) or vacuum molding is employed to form multiple panels (e.g., panels $\mathbf{12}_1$, $\mathbf{12}_2$ and $\mathbf{12}_3$) on the continuous piece of material 20

In such embodiments, panel sections of the continuous piece of material 20 are placed on a platform and bagged. A vacuum is applied within the bag to pull air from one side of the panel section, while resin (or other suitable binding material) is flowed out of tubes or ports on the other side of the panel section. The vacuum pressure pulls the resin through the panel section and disperses it relatively evenly within the panel section. After the resin hardens, the panel section is removed from the bag and forms a rigid or semi-rigid panel. In yet other embodiments, other suitable processes may be employed for forming multiple panels (e.g., panels $\mathbf{12}_1$, $\mathbf{12}_2$ and $\mathbf{12}_3$) on the continuous piece of material 20.

Figure 6:
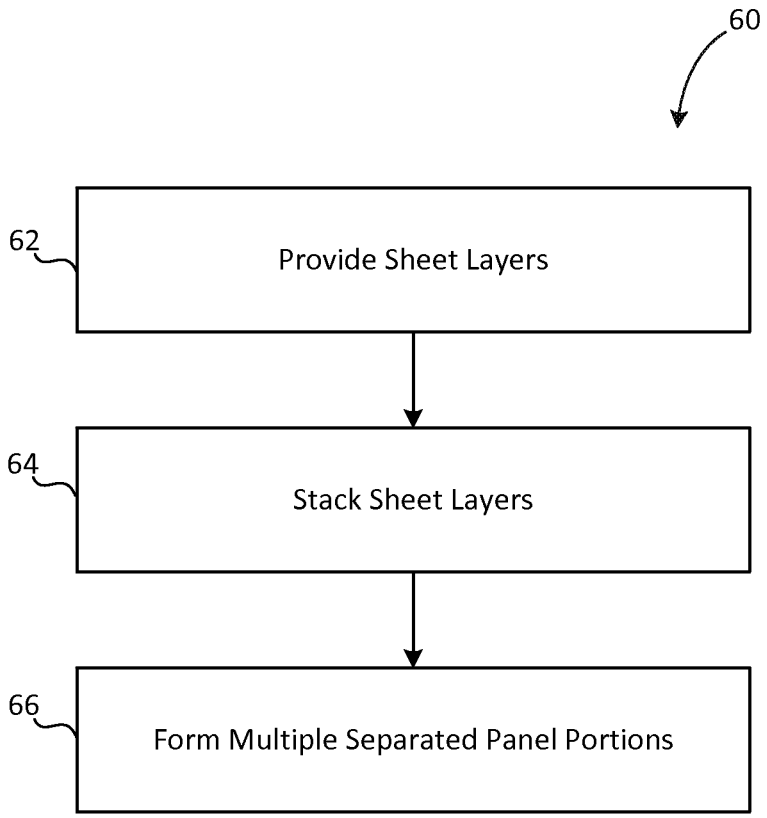
FIG. 6 is a flow chart of a process of making a multi-panel armor structure according to an embodiment of the present invention.

Examples of processes for making a multiple panel armor structure are described with reference to FIG. 6. A process 60 according to FIG. 6 includes a step 62, in which one or more sheet layers for the continuous piece of material 20 are provided (such as, but not limited to, sheet layers 30, 32, 34 and 36 in FIG. 4). In particular embodiments, in step 62, a plurality of sheet layer segments are arranged in an overlapping manner (such as, but not limited to, overlapping sheet layer segments $\mathbf{30}_1$, $\mathbf{30}_2$ and $\mathbf{30}_3$ in FIG. 5) to provide one or more (or each) sheet layer of the continuous piece of material 20. In other embodiments, a single segment of material is provided for one or more (or each) sheet layer.

Figure 3:
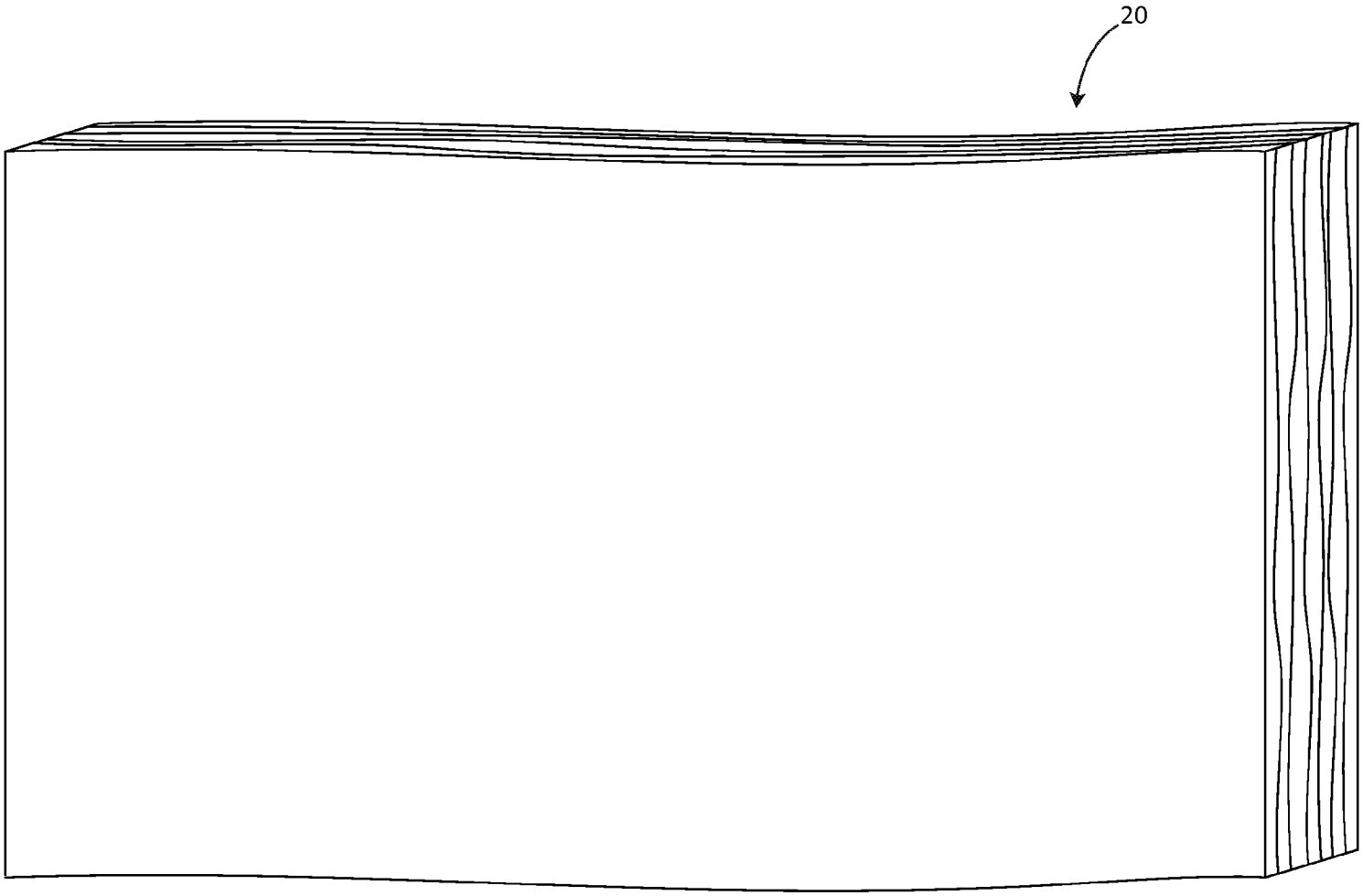
FIG. 3 is a perspective view of a web material for a multi-panel armor structure of FIG. 1*a* or 1*b*.

The sheet layer(s) are stacked at step 64 to form a single continuous piece of flexible material (such as, but not limited to, the continuous piece of material 20 shown in FIG. 3). Then, in step 66, two or more (multiple) predefined and separated sections of the continuous piece of material 20 are pressed and molded, as described above (or processed in an autoclave, RTM, vacuum molding, or other suitable process as described above), to form two or more (multiple) respective panels, separated by one or more hinge portions (such as, but not limited to, panels $\mathbf{12}_1$, $\mathbf{12}_2$, and $\mathbf{12}_3$ and hinge portions $\mathbf{14}_1$ and $\mathbf{14}_2$ in FIG. 1*a* or 1*b*).

Each panel may be rigid or semi rigid, relative to the pre-processed, continuous piece of material 20, when formed (e.g., after being pressed and molded, or otherwise processed as described above). In particular embodiments, each panel (e.g., panels $\mathbf{12}_1$, $\mathbf{12}_2$ and $\mathbf{12}_3$) is sufficiently rigid to hold its shape, when not supported. However, the flexible continuous piece of material 20 in the hinge portions $\mathbf{14}_1$ and $\mathbf{14}_2$ between each adjacent panel was not molded (or processed in an autoclave, RTM or other panel-forming process as described above) and, thus remains sufficiently flexible to form a hinge (e.g., a live hinge) between the adjacent panels, to allow one panel (or both panels) to pivot relative to the adjacent panel. In particular embodiments, the hinge portions $\mathbf{14}_1$ and $\mathbf{14}_2$ allow one or more panels to fold fully over one or more adjacent panels (e.g., as shown in FIGS. 2*a* and 2*b*). In other embodiments, the hinge portions $\mathbf{14}_1$ and $\mathbf{14}_2$ allow only a limited amount of folding or pivoting of one or more panels relative to one or more adjacent panels, such that one or more panels can pivot within a predefined range relative to, but not fold fully over, one or more adjacent panels.

In further embodiments, one or more (or each) of the panels (e.g., panels $\mathbf{12}_1$, $\mathbf{12}_2$ and $\mathbf{12}_3$) is provided with one or more sheets or layers of an additional material for enhancing rigidity, where such additional material may include, but is not limited to, plastic, metal, wood, fiberboard, fiberglass, or other generally rigid or semi-rigid composite or non-composite material. In such further embodiments, the additional material may be laminated or adhered to all or part of one or more (or both) side faces of one or more (or each) of the panels, but not on the hinge portions, to allow the hinge portions to remain flexible. The additional material may be laminated or adhered to one or more (or each) panel by any suitable mechanism including, but not limited to, a glue, resin or other flowable adhesive, the binding material described herein, clamps, bolts, or other hardware, or the like. In other embodiments, one or more (or each) of the panels is formed with sufficient rigidity such that the additional material may be omitted.

In embodiments in which the continuous piece of material 20 is composed of a plurality of continuous sheet layers (such as sheet layers 30, 32, 33 and 36), the number of sheet layers may be selected to provide a desired penetration stopping force or strength. As the sheet layers of the continuous piece of material 20 are continuous across the panel sections and the hinge portions between the panel sections, the penetration stopping force or strength of a multi-panel structure can, likewise be continuous across the panel sections and the hinge portions. For example, a sheet layer material having a pre-determined penetration stopping force or strength S may be selected such that a continuous piece of material 20 composed of a number n of sheet layers can provide a penetration stopping force or strength of n times S (n×S) or some other predetermined function of n and S. The panel sections and high portions of the continuous piece of material have a penetration stopping force or strength across the continuous piece of material that meets at a least a desired, predefined level or rating, when the multi-panel structure is in the unfolded state.

In addition, a multi-panel structure formed with the continuous piece of material 20 can be folded to a folded state as described herein to provide a shield having a higher penetration stopping force or strength, for example, as a multiple (or other function) of the number of panels in the folded state. Thus, a multi-panel structure having a number P of panels that can be stacked in a folded state to provide an overall penetration stopping force or strength of n times S times P (n×S×P) or some other predetermined function of n, S and P. That same multi-panel structure can provide a penetration stopping force or strength of n times S (n×S) when the structure is in an un-folded state.

Thus, in one non-limiting example, a sheet layer material having a penetration stopping force or strength S of (1/30) pound per square foot is employed in each of n sheet layers of a continuous piece of material 20. In that example, a continuous piece of material 20 having thirty (n=30) sheet layers may form a multi-panel structure having a penetration stopping force or strength (n×S) of one (1) pound per square foot, when in an unfolded state. In that example, a multi-panel structure as shown in FIGS. 1A and 1B having three (P=3) panels may have a penetration stopping force or strength (n×S×P) of three (3) pounds per square foot, when in a folded state.

For example, using a rating system in which a penetration stopping force or strength of at least three (3) pounds per square foot corresponds to less than level III, and a penetration stopping force or strength of at least four (4) pounds per square foot corresponds to a level III, the above-described example (where n=30, P=3, and S=1/30 pound per square foot) would have a level rating less than III when the multi-panel structure is in the folded state. In the above example, by employing a sheet layer material with a sufficiently higher penetration stopping force or strength S, and/or by adding ten further layers of the above-described sheet layer material (i.e., n=40), the penetration stopping force or strength (n×S×P) of the multi-panel structure in the folded state can be increased to four (4) pounds per square foot, to correspond to a level III rating.

In further embodiments one or more smaller sheet sections of the sheet layer material or other material as described above (such as, but not limited to, the size and shape of a single panel of a multi-panel structure) are added onto or between any of the layers of the continuous piece of material 20 at the locations of one or more (or each) of the panels, to increase number of layers and, thus, the penetration stopping force or strength (or rating level) of one or more (or each) of the panel sections. In such embodiments, each smaller sheet section of the sheet layer material (or other material) that is added to the continuous piece of material 20 may be arranged to align with a corresponding one of the panel sections (or be within the boundary of a corresponding one of the panel sections) so as to increase the number of layers (and width) of the corresponding panel section, without adding additional layers and width to the adjacent hinge portion(s) of the multi-panel structure.

Figure 7A:
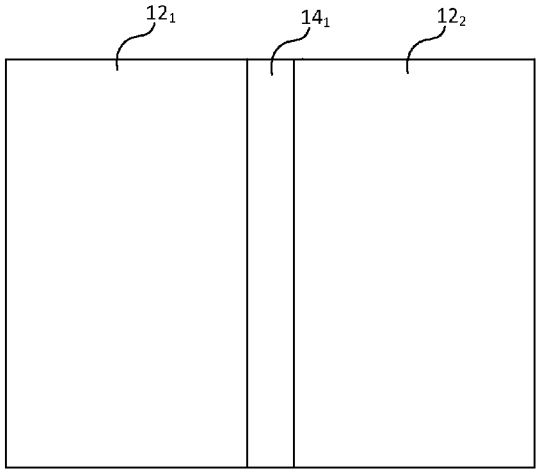

While the multi-panel armor structure embodiments of FIGS. 1*a* and 1*b* include three panels $\mathbf{12}_1$, $\mathbf{12}_2$ and $\mathbf{12}_3$ and two hinge portions $\mathbf{14}_1$ and $\mathbf{14}_2$, other embodiments employ other suitable numbers of panels and hinge portions. For example, another embodiment includes two panels $\mathbf{12}_1$ and $\mathbf{12}_2$ and one hinge portion hinge portions $\mathbf{14}_1$, as shown in FIG. 7*a*.

Figure 7B:
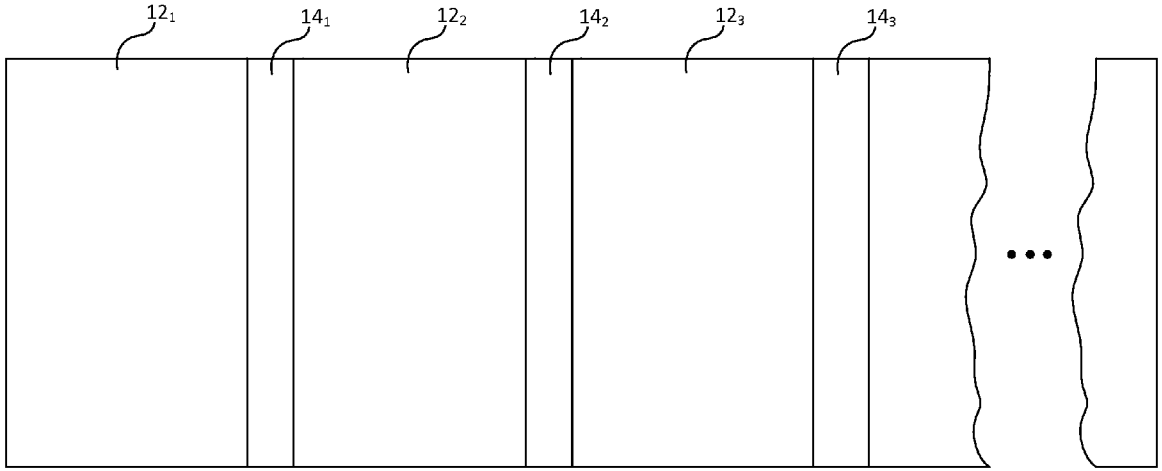
Figure 7C:
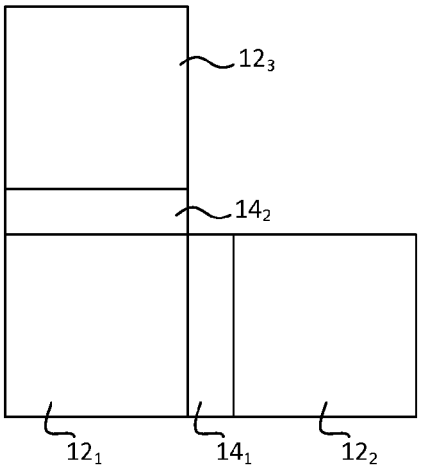
Figure 7D:
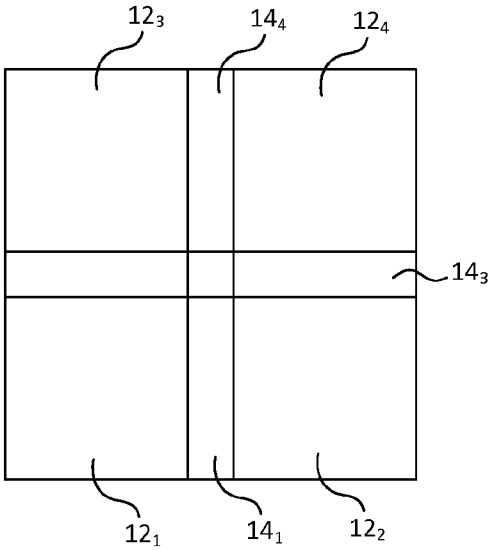
Figure 7E:
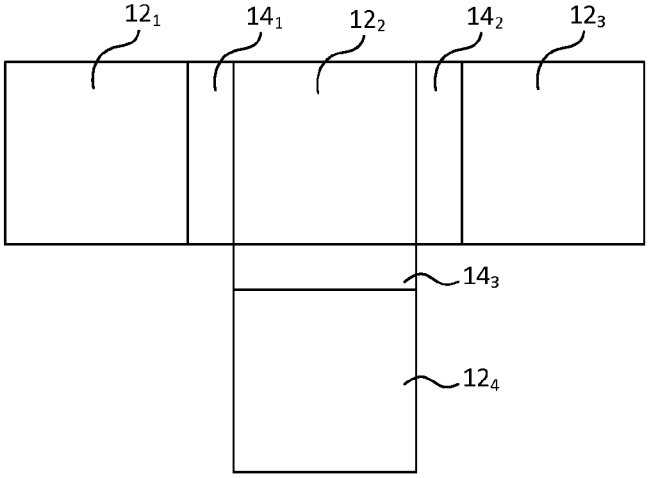

Other multi-panel armor structure embodiments include more than three panels (e.g., $\mathbf{12}_1$, $\mathbf{12}_2$ and $\mathbf{12}_3$, or more) and more than two hinge portions (e.g., $14_1$ and $14_2$, or more), as shown in FIG. 7*b*. While the embodiments in FIGS. 1*a*, 1*b*, 7*a* and 7*b* include panels and hinge portions arranged in a linear fashion, other embodiments include one or more panels (e.g., $12_1$, $12_2$, $12_3$ and $12_4$, or more), and hinge portions (e.g., $14_1$, $14_2$, $14_3$ and $14_4$, or more) arranged non-linear with respect to two or more other panels or hinge portions, as shown in FIGS. 7*c*-7*f*.

While multi-panel armor structure embodiments shown in FIGS. 1*a*-7*f* include rectangular panels, other embodiments include panels having other suitable shapes, such as, but not limited to triangular-shaped panels as shown in FIGS. 7*g*-*k*. In FIG. 7*g*, two adjacent triangular panels $42_1$ and $42_2$ are provided adjacent each other, but separated by a hinge portion 44 and arranged with their apexes directed opposite to each other. In further embodiments more than two triangular panels (e.g., $42_1$, $42_2$ and $42_3$, or more) are provided adjacent each other and with opposite-directed apexes, but separated from each adjacent panel by hinge portions (e.g., $44_1$ and $44_2$, or more), as shown in FIG. 7*h*.

Figure 7I:
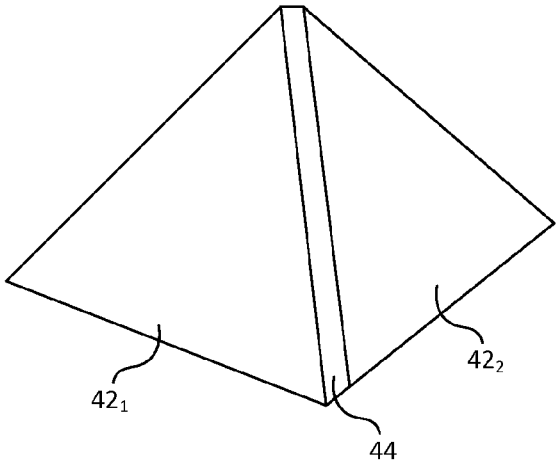
Figure 7J:
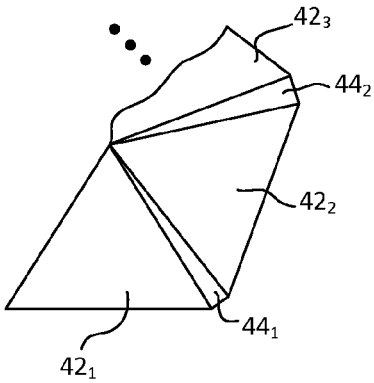
Figure 7K:
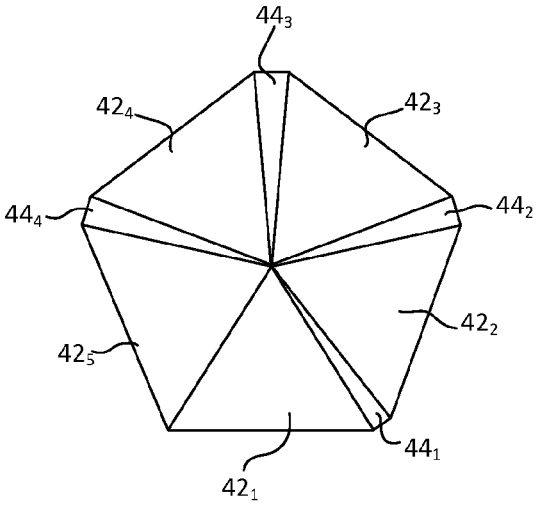

In FIG. 7*i*, two adjacent triangular panels $42_1$ and $42_2$ separated by a hinge portion 44, are arranged with their apexes directed in the same direction (or toward each other). In further embodiments more than two triangular panels (e.g., $42_1$, $42_2$, $42_3$, or more) are provided adjacent each other and with commonly directed apexes, but separated from each adjacent panel by a hinge portion (e.g., $44_1$, $44_2$, or more), as shown in FIG. 7*j*. In yet further multi-panel structure embodiments, a plurality of triangular panels (e.g., $42_1$, $42_2$, $42_3$, $42_4$ and $42_5$) and hinge portions (e.g., $44_1$, $44_2$, $44_3$ and $44_4$) are provided, with adjacent panels arranged with commonly directed apexes, such that their base sides form a circular or polygonal shape, when the multi-panel structure is in an unfolded state, as shown in FIG. 7*k*.

Yet further embodiments may include multiple (repeating) patterns of panels of hinge portions according to any of the embodiments in FIGS. 1*a*, 1*b*, 7*a*-7*k*, or may include combinations of one or more patterns of panels and hinge portions according to those embodiments. Furthermore, while embodiments shown in FIGS. 1*a*, 1*b* and 7*a*-7*k* employ multiple panels of similar shapes and sizes, other embodiments of multi-panel armor structures employ different shaped and/or different sized panels in the same structure. The number of panels and hinge portions, as well as the shape, size and arrangement of panels and hinge portions may be selected, based on the intended purpose and operation of the multi-panel armor structure.

In particular embodiments, the multi-panel armor structure 10 is configured to provide a portable armor shield having a first strength (e.g., a first penetration stopping capability, NIJ level or other rating) when in an unfolded state (e.g., the state shown in FIGS. 1*a* and 1*b*), but has a second strength (e.g., a second penetration stopping capability, NIJ level or other rating) when in the folded state (e.g., the state shown in FIGS. 2*a* and 2*b*).

Figure 8:
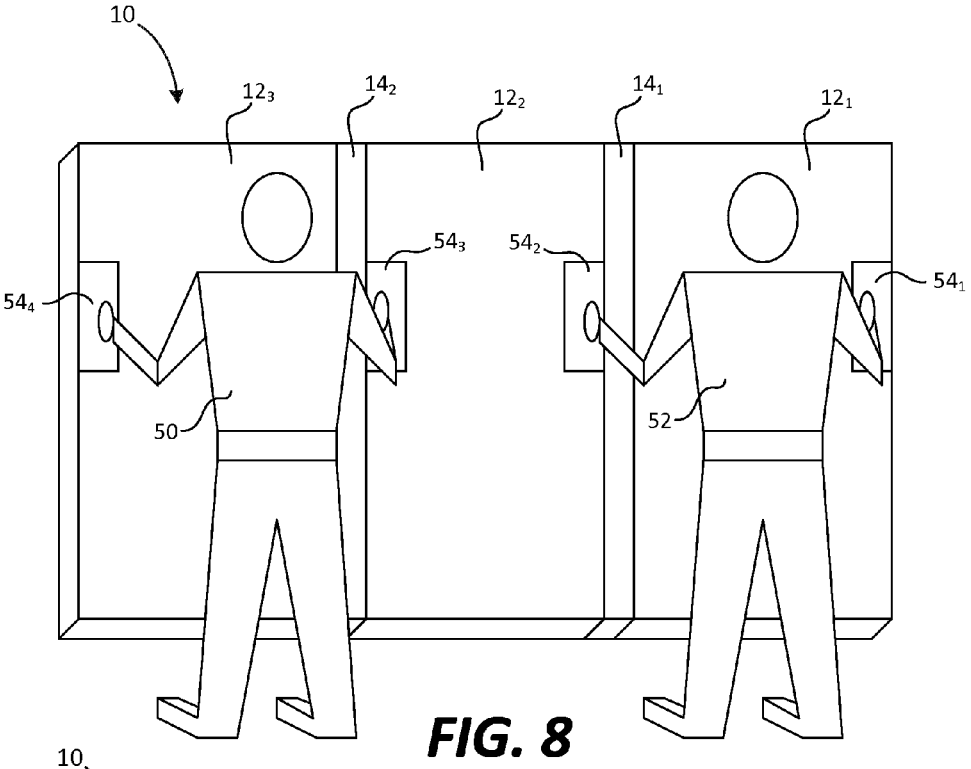
FIG. 8 is a perspective view of a multi-panel armor structure of FIG. 1*a*, in an unfolded state and being carried by two people.

In certain embodiments, the multi-panel armor structure 10 is configured to provide a first type of portable shield, when in an unfolded state (as shown in FIG. 8). In that state, two or more people 50 and 52 may hold the multi-panel armor structure 10 in front of their bodies (as shown in FIG. 8) to provide an armor shielding of a first strength (e.g., a first penetration stopping capability, NIJ level or other rating).

Figure 9:
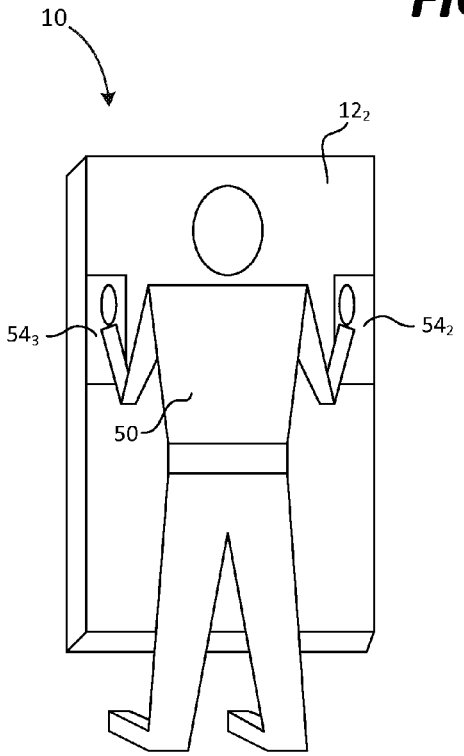
FIG. 9 is a perspective view of a multi-panel armor structure of FIG. 1*a*, in a folded state and being carried by one person.

The multi-panel armor structure 10 is configured to be folded (to a folded state), as described above, to approximately one panel width (as shown in FIG. 9) and provide a second type of portable shield. In that state, a single person 50 may hold the multi-panel armor material 10 in front of his/her body (as shown in FIG. 9) to provide an armor shielding. In particular embodiments, when in the folded state, the multi-panel armor structure 10 provides a second strength (e.g., a second penetration stopping capability, NIJ level or other rating). In particular embodiments, the second strength (or second penetration stopping capability, NIJ level or other rating) is greater than the first strength (or first penetration stopping capability, NIJ level or other rating) due to the multiple panels being folded over each other (or stacked). For example, the multiple panels can provide multiple layers if penetration stopping capability such that, if a projectile passes through the first panel in the stack, the projectile will impact the second panel, and so forth.

While the embodiments of FIGS. 8 and 9 show two people holding the multi-panel armor structure 10 in the unfolded state and one person holding the structure 10 in the folded state, in further embodiments, one person (or more than two people) may hold the multi-panel armor structure 10 in the unfolded state and/or more than one person may hold the structure 10 in the folded state.

In particular embodiments, a foldable multi-panel shield structure as described above is configured to fold in the manner shown in FIG. 2*a*, and is further configured to be carried by a user 50 with the surface $12_2$a (i.e., the surface of panel $12_2$ facing out of the page in FIG. 1*a*) arranged to face the user 50, as shown in FIG. 9. In this manner (and with reference to FIGS. 2*a* and 9), the surface $12_3$a (i.e., the surface of panel $12_3$ facing out of the page in FIG. 1*a*) is arranged to face the direction of a potential threat, to be the initial surface of impact of a projectile. In that arrangement, the panel directly adjacent the user 50 (i.e., panel $12_2$) is connected to other panels $12_1$ and $12_3$ in the folded stack of panels by the hinge portions $14_1$ and $14_2$ on either side of the panel $12_2$, such that the panel $12_2$ will not swing outward and hit the user 50 in response to a projectile impact on the surface $12_3$a.

In particular embodiments of a foldable armor shield structure 10 as shown in FIGS. 8 and 9, one or more (or each) of the panels $12_1$, $12_2$ and $12_3$ is provided with one or more handles (e.g., $54_1$, $54_2$, $54_3$ or $54_4$) for a user to hold and carry the structure. The handle(s) may be any suitable shape that provides a grip or holding member to allow a user to grip and hold the structure 10, for example, in the orientations shown in FIGS. 8 and 9. In those orientations, the armor shield structure 10 can be used as a protective shield against projectiles traveling toward the side of the structure 10 opposite to the side facing the user 50 and 52. In the embodiment of FIGS. 8 and 9, a first handle $54_1$ is provided on the panel $12_1$, while second and third handles $54_2$ and $54_3$ are provided on the panel $12_2$ and a fourth handle $54_4$ is provided on the panel $12_3$.

In particular, the first handle $54_1$ is provided adjacent the free edge (the edge opposite the hinged edge) of the panel $12_1$. Similarly, fourth handle $54_4$ is provided adjacent the free edge (the edge opposite the hinged edge) of the panel $12_3$. The second and third handles $54_2$ and $54_3$ are provided adjacent the two respective hinged edges of the panel $12_2$. In that configuration, when the multi-panel armor structure 10 is in an unfolded state (as shown in FIG. 8), two people 50 and 52 may grip the four handles $54_1$, $54_2$, $54_3$ and $54_4$ (where one person 50 grips the handles $54_3$ and $54_4$, while the other person 54 grips the handles $54_1$ and $54_2$, to hold or carry the structure 10, together. In addition, when the multi-panel armor structure 10 is in a folded state (as shown in FIG. 9), one person 50 may grip the two handles $54_2$ and $54_3$ on the panel $12_2$ to hold or carry the structure 10. In other embodiments, more or less than four handles may be provided at any suitable locations on the multi-panel armor structure 10, and on one or both sides of the multi-panel armor structure 10 (i.e., the sides facing into or out of the page in FIG. 1). Also, in other embodiments, the handles may be arranged to allow any suitable number of people to grip and hold the multi-panel armor structure, as described above.

One or more (or each) handle may be attached to the panels of the multi-panel armor structure in any suitable manner, including, but not limited to glue or other adhesive, straps, clips, rivets, screws, bolts or other suitable connectors. However, particular embodiments avoid the use of connectors with parts that can break away toward the user 50 or 52, when a projectile impacts the armor shield structure. In further embodiments, one or more (or each) handle may be molded onto a panel, for example, during or after the step 66 (FIG. 6) of pressing and molding the panel from the web material 20. In yet further embodiments, the multi-panel armor structure 10 is configured to be encased within a durable, fabric sleeve or pouch when in the unfolded state (FIG. 8) or the unfolded state (FIG. 9), or both. In such embodiments, the fabric sleeve, pouch or other suitable outer cover layer may be provided with one or more handles (such as the four handles $\mathbf{54}_1$, $\mathbf{54}_2$, $\mathbf{54}_3$ and $\mathbf{54}_4$). In yet other embodiments, a protective or decorative layer, coating (such as, but not limited to a Line X™ coating or similar coating), adhesive-backed sheet, laminate or the like is applied the multi-panel armor structure 10, in addition to or as an alternative to a sleeve or pouch.

In further embodiments, one or more of the panels of a multi-panel armor shield structure (e.g., panels $\mathbf{12}_1$, $\mathbf{12}_2$ and $\mathbf{12}_3$) is provided with an opening or window for allowing a user 50 or 52 to view through the opening in the panel, or to fire a weapon through the opening in the panel, or both. In further embodiments, one or more of the panels of a multi-panel armor shield structure (e.g., panels $\mathbf{12}_1$, $\mathbf{12}_2$ and $\mathbf{12}_3$) is provided with one or more pockets, loops of material, clips, or other connectors or receptacles for holding equipment, such as, but not limited to, lights, weapons, cameras, ammunition, provisions, or the like. In yet further embodiments, one or more of the panels is provided with a durable fabric sleeve or cover on which one or more of such connectors or receptacles are provided. In particular embodiments, the sleeve or cover is the same sleeve or cover that includes handles as described above.

While the embodiments described with reference to FIGS. 8 and 9 employ a three-panel armor structure 10, other embodiments (such as, but not limited to those described above) employ two or more than three panels, and may employ panels of various sizes and shapes, and connected in various arrangements to form multi-panel armor shields that are shaped and sized to meet the operational needs for the desired environment of use.

While particular embodiments are configured to provide a portable shield that can be carried by one or more persons, other embodiments are configured to provide other multi-panel armor structures. Other multi-panel armor structures include, but are not limited to portable barrier wall structures, installed barrier wall structures, tents, vehicle or equipment covers, ammunition covers, or the like.

Figure 10:
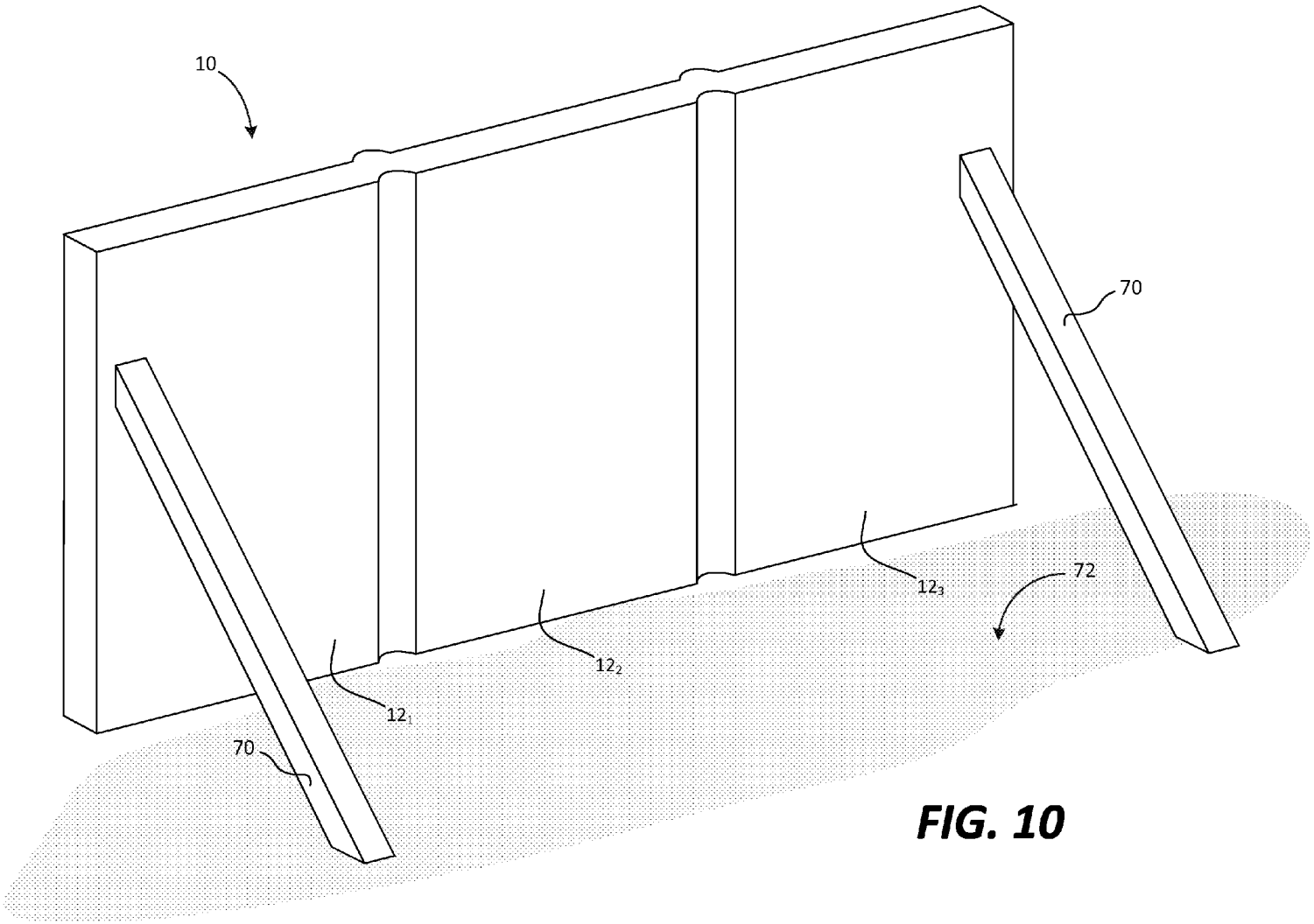
FIG. 10 is a perspective view of a multi-panel armor wall structure according to an embodiment of the present invention.

For example a multi-panel armor structure according to any of the embodiments discussed herein, may be configured as a barrier wall structure. In particular embodiments, the multi-panel armor structure is configured to provide a portable, free-standing wall or barrier that can be carried to a desired location and set on a flat or nearly flat surface to stand upright and provide an armor wall or barrier between personnel or equipment and a potential threat. For example, with reference to the three-panel armor structure 10 of FIGS. 1*a* and 1*b*, in particular embodiments, the panels $\mathbf{12}_1$ and $\mathbf{12}_3$ are folded partially, but not fully, relative to a fully unfolded state, such that the panels $\mathbf{12}_1$ and $\mathbf{12}_3$ are not parallel to (or in the same plane as) the panel panels $\mathbf{12}_2$ (as shown in FIG. 1*a*). In that partially folded state, the bottom edge (relative to the orientation in FIG. 1*a*) of the panels can be set on a flat or nearly flat surface, and stand upright. In other embodiments, a multi-panel armor structure according to any of the embodiments described herein includes one or more leg or support members (such as support members 70 in FIG. 10), to support (or partially support) the structure 10 in an upright orientation, on the ground or other surface 72. In such embodiments, the one or more support member 70 may include a rigid rod or leg that has one end attached to or abutting against one or more respective panels of the multi-panel armor structure, while the other end of the rod or leg is secured to (or rests on) the ground or other surface. In other embodiments, each rod or leg of the support member 70 is pivotally attached at one end to a respective panel, so as to be pivotal outward, to provide a support function, or pivoted inward toward the panel for folding, carrying or storing the multi-panel armor structure.

Figure 11:
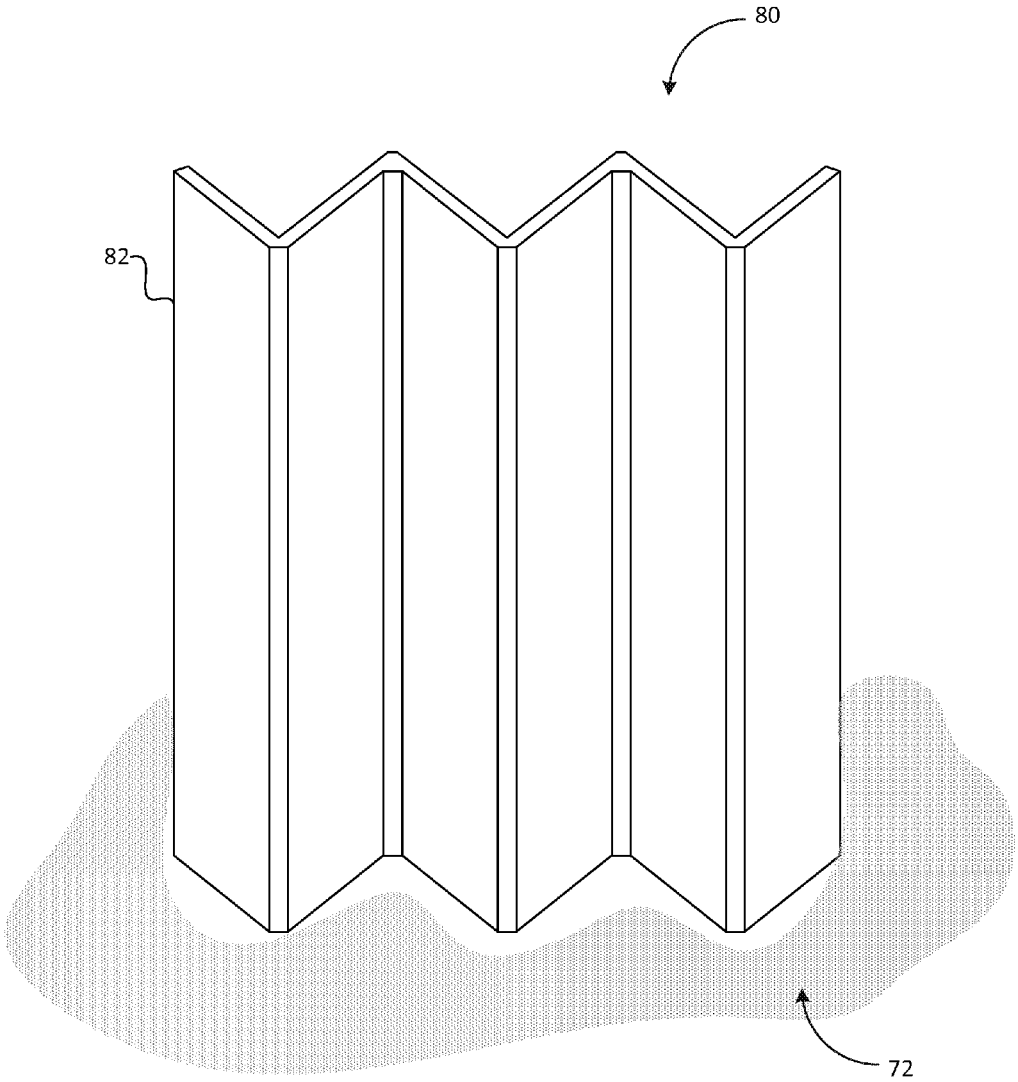
FIG. 11 is a perspective view of a multi-panel armor wall structure according to another embodiment of the present invention.

In yet other embodiments, a multi-panel armor structure is configured as a foldable armor wall structure 80 as shown in FIG. 11. The foldable armor wall structure 80 is configured with multiple panels and hinge portions according to any suitable embodiment of multi-panel armor structures described herein. While the embodiment of FIG. 11 includes five panels and four hinge portions, other embodiments may employ any suitable number, size and shape of panels and hinge portions, such as described herein. In the embodiment of FIG. 11, the foldable armor wall structure 80 is configured to fold in an accordion manner (for example, with adjacent hinge portions arranged in opposite directions as described above with respect to FIGS. 1*b* and 2*b*). In a partially unfolded state, as shown in FIG. 11, the multi-panel foldable armor wall structure 80 is configured to stand upright on a ground or other flat or nearly flat surface 72, with one edge of each panel (the bottom edge in FIG. 11) resting on the ground or surface 72.

In particular embodiments, one side edge 82 of the foldable armor wall structure 80 is connected (or configured to connect) to a fixed wall of a building, vehicle, or other structure and, thus, forms an installed armor wall structure. The installed armor wall structure 80 may be folded up against the fixed wall (or into a cabinet, nook or cubby in the fixed wall, for example, when not in use. The installed wall structure may be unfolded and extended outward from (or along) the fixed wall, when in use. In such embodiments, the foldable armor wall structure 80 may be folded to a compact, folded state and stowed away, out of sight and out of traveled pathways when not needed, but then may be quickly deployed (unfolded and extended) to provide an armor barrier, when desired.

Figure 12:
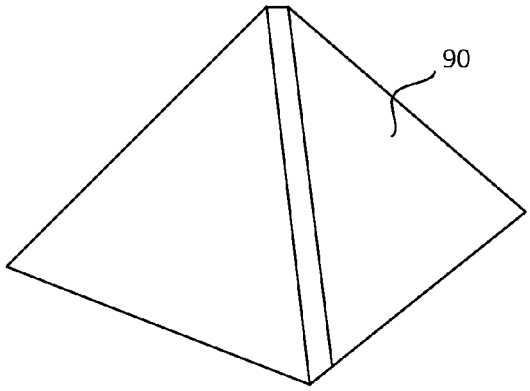
FIG. 12 is a perspective view of a multi-panel armor wall structure according to another embodiment of the present invention.
Figure 13:
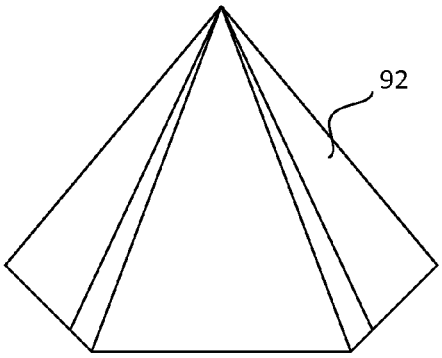
FIG. 13 is a perspective view of a multi-panel armor wall structure according to another embodiment of the present invention.

In yet further embodiments as shown in FIGS. 12 and 13, examples of multi-panel armor wall structures 90 and 92, that are configured with multiple walls connected and arranged to provide an enclosed interior that is fully surrounded (or, in other embodiments, partially surrounded) by panels and hinge portions as described herein.

For example, a multi-panel armor wall structure 90 in FIG. 12 is configured with four panels, each having a triangular shape, connected together in a manner similar to that shown and described with respect to FIG. 7*j*. In FIG. 12, two of the four panels of the structure 90 are in view, while two of the four panels are facing into the page and out of view, but are arranged parallel to the two panels in view. In particular embodiments, one adjacent pair of the four panels is not connected to each other by a hinge, to allow one of the panels in the pair to pivot to an open position and allow access to the interior of the enclosure. In other embodiments, one of the above-noted four panels may be omitted, to provide an open side to the enclosure. In yet other embodiments, two adjacent (or opposed) panels of the above-noted four panels may be omitted, to provide a larger opening (or opposed openings) into the enclosure.

While the embodiment in FIG. 12 includes four panels (or two or three panels with one or two open panel positions), other embodiments employ three panels or more than four panels to form a complete enclosure. In such embodiments, one or more than one panel may be omitted to provide one or more openings into the interior of the enclosure, and/or at least one adjacent pair of panels are not connected by a hinge portion to provide access to the interior, as described above. For example, the embodiment of FIG. 13 includes five panels connected by hinge portions as described herein, where three of the five panels are in view, while two of the five panels are facing into the page and out of view in the drawing.

In the embodiments of FIGS. 12 and 13 (and variations with other numbers of panels as discussed above), the multi-panel wall structure may be deployed to form an armor enclosure as shown in FIGS. 12 and 13 when in use, but may be folded along the hinge portions (e.g., by folding one panel over an adjacent panel, as described herein), to a folded state. In the folded state, the structure may be more readily stored and transported. In further embodiments, such structures, when in their folded states, can form armor shields that can be carried or set in place, as described above.

Figure 14:
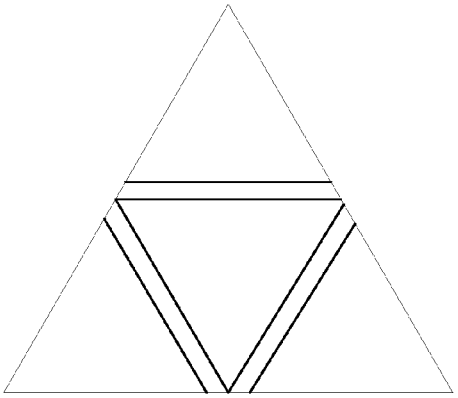
FIG. 14 is a panel of a multi-panel armor wall structure according to a further embodiment of the present invention.

In further embodiments, any one or more (or each) of the triangular panels of the structure 90 in FIG. 12 or the structure 92 in FIG. 13 (or any of the variations discussed above) is, itself, formed of a plurality of panels connected by hinge portions described herein, as shown in FIG. 14, for folding into yet more compact states. In any of the armor wall structures described herein, one or more of the panels may be provided with one or more openings or windows as described above, or other openings, doors or windows to allow access through the panel or into the interior of an enclosure formed with the panel.

The size and shape of an enclosure formed by a multi-panel structure according to embodiments of the present invention may be configured to accommodate a desired purpose. In particular embodiments, the panel shapes and sizes are selected to provide an enclosure having sufficient size to operate as an armored tent for personnel (such as a one-person, two person or more tent). In other embodiments, the panel shapes and sizes are selected to provide an enclosure having a sufficient size to operate as an armor garage or vehicle enclosure, an armor field office, base or medical care structure, or the like. In yet other embodiments, the panel shapes and sizes are selected to provide smaller enclosures for enclosing radio or other electronics, ammunition, or other items for which armor protection is desired.

The preceding description of the disclosed embodiments is provided to enable any person skilled in the art to make or use the present invention. Various modifications to these embodiments will be readily apparent to those skilled in the art, and the generic principles defined herein may be applied to some embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A multi-panel armor structure comprising a plurality of panels formed with a continuous piece of material, each panel comprising:

a portion, but not all of the continuous piece of material;

a binding material associated with the portion of the continuous piece of material and forming, with the portion of the continuous piece material, a rigid panel having or exceeding at least one of a predefined penetration stopping capability or a predefined NIJ rating;

wherein each panel is spaced from at least one adjacent panel by a hinge portion formed of the continuous piece of material between the panel and each adjacent panel, the hinge portion allowing pivotal motion of at least one of the panels relative to at least one other panel; and wherein the hinge portions are configured to allow pivotal motion of the at least one panel from an unfolded state to a folded state, wherein in the folded state the at least one panel is folded over the at least one other panel to form a stack of panels; and wherein the binding material is molded with the portion of the continuous piece material to form a generally rigid panel, the hinge portion being sufficiently free of the binding material to be flexible and allow the pivotal motion.

2. A multi-panel armor structure as recited in claim 1, wherein the binding material is molded with the portion of the continuous piece material to form a generally rigid panel, the hinge portion including the binding material but is not molded so as to remain flexible to allow the pivotal motion.

3. A multi-panel armor structure as recited in claim 1, wherein the plurality of panels comprises at least three panels connected together by at least two hinge portions of the continuous piece of material, wherein each panel is connected to an adjacent panel by a respective one of the hinge portions of the continuous piece of material.

4. A multi-panel armor structure as recited in claim 1, wherein the stack of panels has a plurality of layers arranged in a stack, each layer having no more than one panel.

5. A multi-panel armor structure as recited in claim 4, wherein the stack of panels has a width dimension that is less than a corresponding width dimension of two panels in the unfolded state.

6. A multi-panel armor structure as recited in claim 1, wherein the continuous piece of material comprises a plurality of stacked, flexible sheet layers of an ultra-high-molecular-weight polyethelene material.

7. A multi-panel armor structure as recited in claim 1, wherein the continuous piece of material comprises at least one of ultra-high-molecular-weight polyethelene, aramid, glass-fiber reinforced plastic (fiberglass), carbon fiber, Kevlar™, Dyneema™, Gold Flex™, Twaron™, Spectra™, Zylon™, or other composite materials.

8. A multi-panel armor structure as recited in claim 1, wherein the continuous piece of material comprises a plurality of stacked, flexible sheet layers and wherein each sheet layer comprises a plurality of sheet layer segments arranged in a partially overlapping manner to form a sheet layer.

9. A multi-panel armor structure as recited in claim 1, wherein each panel of the plurality of panels is connected to an adjacent panel of the plurality of panels by a respective one of the hinge portions of the continuous piece of material to form an armor wall structure when the panels are in an unfolded state.

10. A multi-panel armor structure comprising a plurality of panels formed with a continuous piece of material, each panel comprising:

a portion, but not all of the continuous piece of material;

a binding material associated with the portion of the continuous piece of material and forming, with the portion of the continuous piece material, a rigid panel having or exceeding at least one of a predefined penetration stopping capability or a predefined NIJ rating;

wherein each panel is spaced from at least one adjacent panel by a hinge portion formed of the continuous piece of material between the panel and each adjacent panel, the hinge portion allowing pivotal motion of at least one of the panels relative to at least one other panel; and wherein the plurality of panels comprises at least three panels connected together by at least two hinge portions of the continuous piece of material, wherein each panel is connected to an adjacent panel by a respective one of the hinge portions of the continuous piece of material, and wherein the at least three panels and at least two hinge portions are configured to fold in an accordion manner to a folded state.

11. A multi-panel armor structure as recited in claim 10, wherein at least one of the panels is configured to connect to a fixed wall, to allow the at least three panels and at least two hinge portions to unfold in an accordion manner to an unfolded state in which the at least three panels extend from or along the fixed wall.

12. A multi-panel armor structure as recited in claim 1, further comprising a sleeve, coating or layer of protective material at least partially covering at least one of the panels.

13. A multi-panel armor structure as recited in claim 1, further comprising a sleeve of fabric at least partially covering at least one of the panels, the sleeve having at least one of a strap, a pocket, a loop of material, a handle, a connector or a receptacle for holding equipment.

14. A multi-panel armor structure as recited in claim 1, further comprising at least one handle coupled to at least one of the plurality of panels.

15. A multi-panel armor structure as recited in claim 14, wherein the at least one handle is molded on the at least one panel.

16. A multi-panel armor structure as recited in claim 1, further comprising a plurality of handles coupled to two or more of the plurality of panels, the plurality of handles arranged for two or more people to grip the handles and hold the multi-panel armor structure when the plurality of panels are arranged in an unfolded state.

17. A multi-panel armor structure as recited in claim 16, wherein the plurality of handles are arranged for at least one person to grip at least two of the handles and hold the multi-panel armor structure when the plurality of panels are arranged in a folded state.

18. A multi-panel armor structure comprising a plurality of panels formed with a continuous piece of material, each panel comprising:

a portion, but not all of the continuous piece of material;

a binding material associated with the portion of the continuous piece of material and forming, with the portion of the continuous piece material, a rigid panel having or exceeding at least one of a predefined penetration stopping capability or a predefined NIJ rating;

wherein each panel is spaced from at least one adjacent panel by a hinge portion formed of the continuous piece of material between the panel and each adjacent panel, the hinge portion allowing pivotal motion of at least one of the panels relative to at least one other panel; and wherein each panel of the plurality of panels is connected to an adjacent panel of the plurality of panels by a respective one of the hinge portions of the continuous piece of material to form an enclosure having an interior volume when in an unfolded state.

19. A multi-panel armor structure as recited in claim 18, wherein the plurality of panels are connected together by hinge portions configured for one or more panels to fold over an adjacent panel to form a single-panel-wide structure in a folded state.

20. A method of making a multi-panel armor structure, the method comprising:

providing a continuous piece of flexible, high-strength material;

processing a first portion of the continuous piece material with a binding material to form a first rigid panel having or exceeding at least one of a predefined penetration stopping capability or a predefined NIJ rating;

processing a second portion of the continuous piece of flexible, high-strength material with the binding material to form a second panel having or exceeding at least one of a predefined penetration stopping capability and a predefined NIJ rating, the second panel being spaced from the first panel by a further portion of the continuous piece of flexible, high-strength material that forms a hinge portion between the first and second panels, the hinge portion allowing pivotal motion of at least one of the first and second panels relative to at least one other of the first and second panels; and configuring the hinge portion to allow pivotal motion of the first and second rigid panels relative to each other from an unfolded state to a folded state, wherein in the folded state the first rigid panel is folded over the second rigid panel to form a stack of panels; and wherein the hinge portion has sufficiently less binding material than the first and second portions that form the first and second rigid panels, to be flexible and allow the pivotal motion.

21. A method as recited in claim 20, wherein the continuous piece of material comprises a plurality of stacked, flexible sheet layers of an ultra-high-molecular-weight polyethelene material.

22. A method as recited in claim 20, wherein the continuous piece of material comprises at least one of ultra-high-molecular-weight polyethelene, aramid, glass-fiber reinforced plastic (fiberglass), carbon fiber, Kevlar™, Dyneema™, Gold Flex™, Twaron™, Spectra™, Zylon™, or other composite materials.

23. A method as recited in claim 20, wherein the continuous piece of material comprises a plurality of stacked, flexible sheet layers and wherein the method further comprises forming at least one of the flexible sheet layers with a plurality of sheet layer segments arranged in a partially overlapping manner.

24. A multi-panel armor structure as recited in claim 1, wherein the panels in the unfolded state form a first shield structure adapted to be carried or free-standing, and the panels in the folded state form a second shield structure adapted to be carried or free-standing, each of the first and second shield structure having or exceeding the at least one of a predefined penetration stopping capability or a predefined NIJ rating.

* * * * *